US005570630A

United States Patent [19]

Molitorisz et al.

[11] Patent Number: 5,570,630

[45] Date of Patent: Nov. 5, 1996

[54] METHOD FOR COMPACTING AND BALING REFUSE AND WASTE MATERIAL

[76] Inventors: Joseph Molitorisz, 15326 SE. 43rd Pl., Bellevue, Wash. 98006; Reuben J. Smith, 23004 Highway 9, Woodinville, Wash. 98072

[21] Appl. No.: 569,933

[22] Filed: Dec. 8, 1995

[51] Int. Cl.[6] ..... B30B 9/30

[52] U.S. Cl. ..... 100/3; 100/34; 100/100; 100/229 A; 100/258 R; 100/269.13; 100/46

[58] Field of Search ..... 100/3, 34, 35, 100/46, 100, 229 A, 258 R, 269.11, 269.13

[56] References Cited

U.S. PATENT DOCUMENTS 3,726,211 4/1973 Gladwin ..... 100/229 A 4,057,009 11/1977 Burford et al. ..... 100/46

5,448,945 9/1995 Taylor et al. ..... 100/229 A

FOREIGN PATENT DOCUMENTS 8200548 9/1983 Netherlands ..... 100/229 A

*Primary Examiner*—Stephen F. Gerrity

[57] ABSTRACT

Method for compacting refuse or waste material in an enclosed baler-compactor, applying controlled angularity of the platen for even compacting and improved distribution of the compacted material in the container of a container-lift assembly. Tying the compacted material into high density bales or bundles for efficient handling and disposal.

1 Claim, 3 Drawing Sheets

METHOD FOR COMPACTING AND BALING REFUSE AND WASTE MATERIAL

BACKGROUND OF THE INVENTION

Disposal of refuse and waste material is a major environmental concern in the industrial world. Handling and disposal of such material in commercial operations, such as hotels, restaurants, fast-food industries, cafeterias, shops and other establishments requires packaging for handling, transportation and disposal. It is usually collected in light-gauge plastic bags, which are called in this application as "primary bag", and the filled bags are inserted into more durable heavy gauge plastic bags, which are called "secondary bag". The primary and secondary bags together with the waste material are disposed of at the disposal site. To reduce the volume of the disposed refuse, or waste material, in some operations compacting is applied.

SUMMARY OF THE INVENTION

This invention is directed to useful, economical and safe method for disposal of refuse and waste material. It is applicable to mainly dry material, or material containing mixture of dry substance and limited amount of liquids usually found in waste of restaurants, hotels and the like. It provides a method by which the volume of the waste material is reduced significantly under compacting, and the reduced volume is maintained in tied bales. Dry substance with sufficient physical dimension and cohesiveness can be baled without the use of bags. For material with shorter physical dimension, and lacking cohesiveness, primary bags are necessary to hold together the bale. For restaurant and hotel waste, which is usually collected in light gauge primary plastic bags, the filled bags can be compacted into dense bales without using the secondary bag. For waste material with high liquid content, the individual light gauge primary bags have to be placed into heavier gauge watertight secondary bags for reduction or elimination of spilling of the liquids during and after baling. Retaining the high density of the tied bale increases the weight of the disposed material in the bag, this reduces the number of bags needed, reducing the amount of the non-decomposing plastic at the final disposal site. This is significant for environmental consideration.

One of the unique features of this invention is the application of the adjustable and automatically controlled angularity of the platen for improved distribution of the material under compaction in the container of the container-lift assembly. The electrically controlled and hydraulically activated platen bar is allowed to take limited and controlled angularity in the vertical plane during its downward motion, exerting forces with lateral components on the material under compaction.

The adjustable and automatically controlled angularity of the platen bar is also applied to achieve even compaction when the distribution of the material, or its resistance against the compacting forces is uneven.

In the method of this invention the filled light gauge primary bags are placed and stored in the enclosed confinement of the baling-compacting apparatus, for periodic compacting. The cabinet-like structure provides sufficient volume for storing several of the bags before compacting, and allows the adding of more bags after each periodic compacting, until the desired density and size of the bale is achieved.

The cycle of the operation is as follows; The loading doors of the baler-compactor are closed, and the platen of the compactor is moved to its uppermost position by hydraulic power. The loading doors are opened again, and the container-lift assembly is inserted into the cavity of the baling-compacting apparatus, and is secured. The retaining twine is installed. The container and the internal cavity of the baler-compactor are filled with the loose material or with the filled primary bags to be compacted. After closing the loading doors the platen is hydraulically activated to move downward, compressing and forcing the bags into the container. This operation can be repeated until the container is filled. When the desired bale size and density are achieved, the platen is held in its down position, the twine is tied to form a tight loop around the compacted waste material, forming a bale. After tying the twine, the loading doors are closed, allowing the activating of the platen to move to its uppermost position, then the loading doors are opened and the container-lift assembly is released and is removed from the compactor housing, together with the bale. The container-lift assembly is wheel mounted for easy moving of the bale to the temporary disposal site, such as a bin, or dumpster. The container is lifted by the lifting mechanism of the container-lift assembly to the desired height, at which the front wall and the bottom of the container are released, allowing the dumping of the bale into the bin. The bale having a nearly cube shape provides efficient use of the volume of the bin.

The above described method provides the following unique and novel features of the invention;

(a) safe storage for the refuse or waste material inside the confined environment of the baler-compactor, prior to baling, (b) reduced dispersion of odor of the waste material, (c) reduced excess for insects and rodents, (d) convenient and safe handling of the baled material, (e) high density, thereby reduced volume of the waste material, (f) even distribution and even compacting of the material in the container of the container-lift assembly, (g), reduced possibility of bodily injury by objects, such as glass, when breaking up under the compacting forces inside the enclosed confinement of the baling-compacting apparatus, (h), reduced possibility of spilling of liquids from breaking or collapsing containers while being compacted inside the enclosed confinement of the baling-compacting apparatus, (i), reduced possibility of spilling the waste material during transfer from the baling-compacting apparatus to the temporary storage bin or dumpster.

DESCRIPTION OF THE BALER-COMPACTOR

Figure 1:
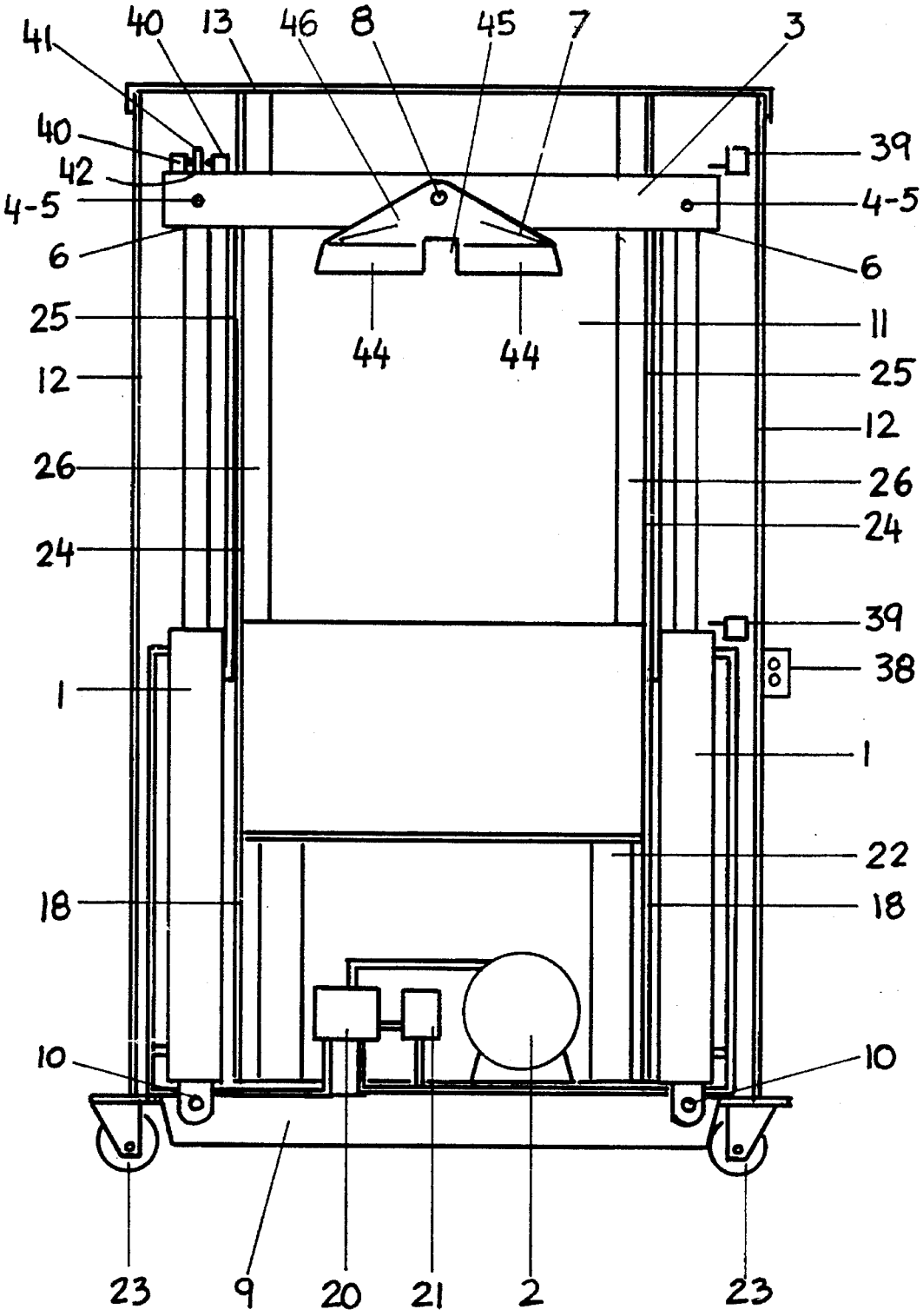
FIG. 1 is a cross-sectional elevation of the compactor.
Figure 2:
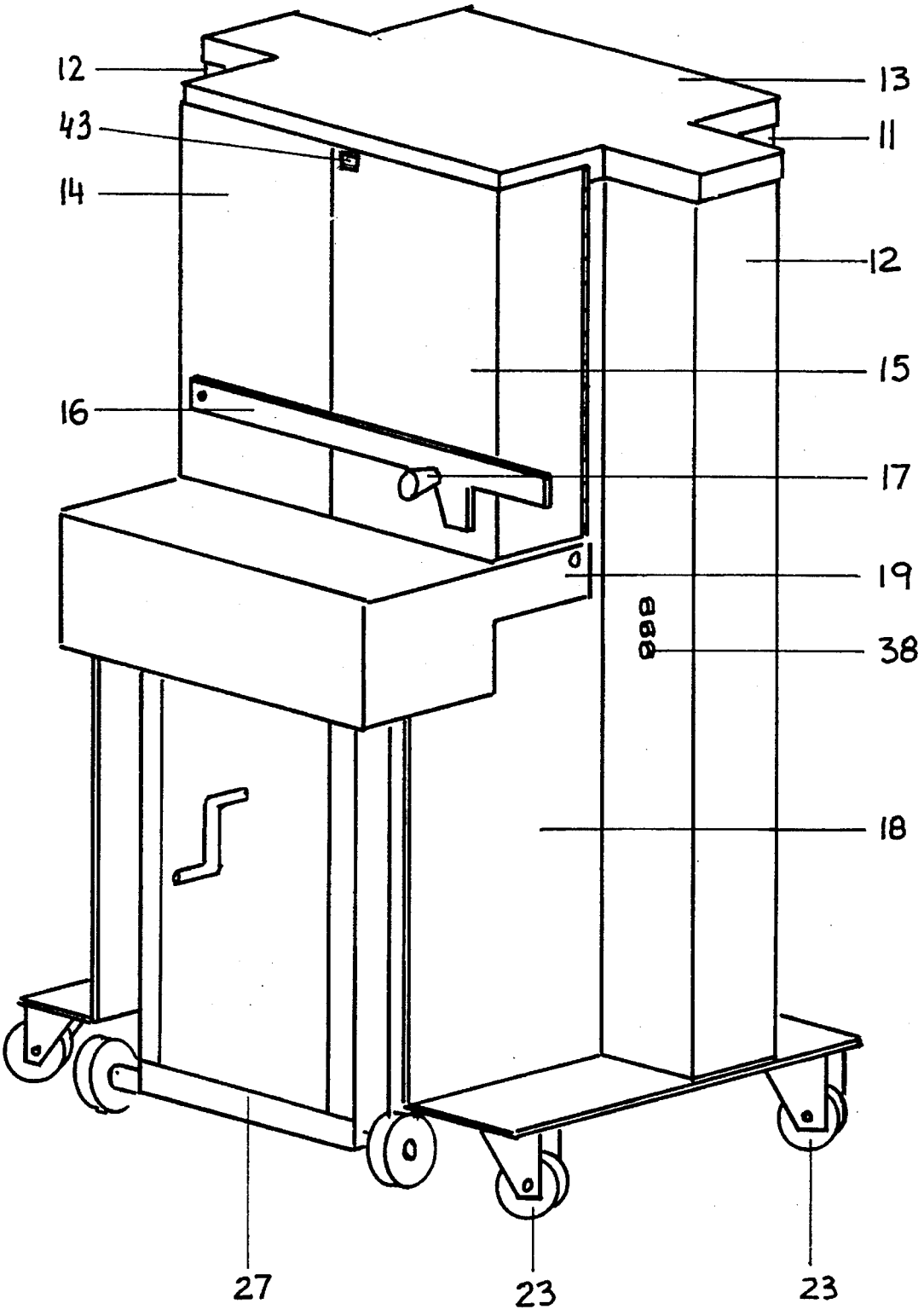
FIG. 2, is an isometric schematic diagram of the compacting apparatus and the container-lift assembly.
Figure 3:
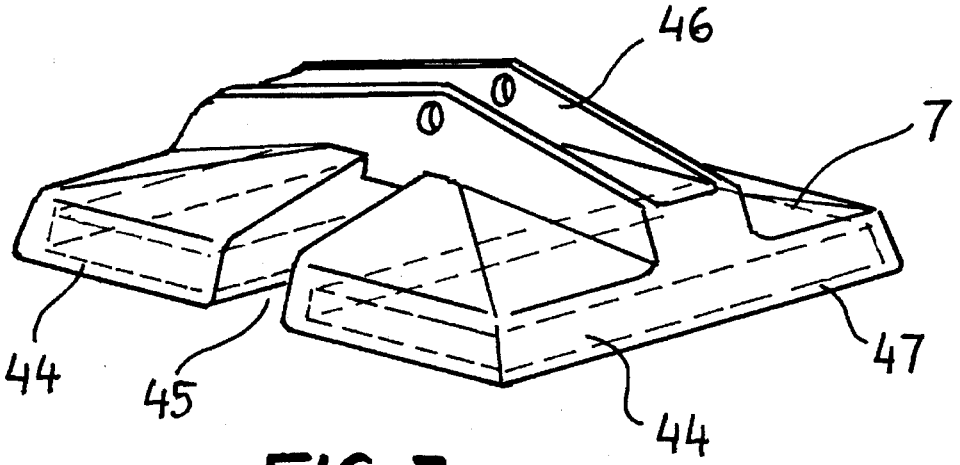
FIG. 3 is an isometric diagram of the platen.

The compactor comprises; two double acting hydraulic cylinders (1) which are connected to the hydraulic power unit (2) in a parallel hydraulic circuit for simultaneous activation, shown on FIG. 1. The cylinders are parallel to each other, and are in a vertical plane. The platen bar (3) at or near its opposite ends is attached to the rods of both cylinders by pins (4), which are inserted through the holes (5). The holes (6) through which the cylinder rods are inserted are sized allowing limited angularity of the platen bar relative to the cylinder rods in the common plane of the longitudinal axes of cylinder rods. The platen (7) is attached to the platen bar by the pin (8). The platen and platen bar assembly moves in the vertical plane under the action of the hydraulic cylinders (1). The platen, shown on FIG. 3, is an aluminum casting. It has two rectangular compacting plates (44) and a slot (45) between the plates. The two compacting plates (44) are connected by a bridge structure (46). The bridge has two side walls enclosing an open channel for the insertion of the platen bar (3). The side walls have a hole for the insertion of a pin (8) to secure it to the platen bar. The compacting plates (44) have downward extended angular rims (47) to force the material under compacting away from the inside walls of the compactor cabinet. The top surface of the platen is sloping toward the outer edges to prevent accumulation of material. The cylinders (1) are attached to the frame of the compactor (9) by the pins (10), allowing limited angular motion in the common vertical plane of the longitudinal axes of the cylinders. The cabinet of the compactor, shown on FIG. 2, has a rear wall (11), two side channels (12) to cover the cylinders, top cover (13), the hinged doors (14) and (15), the door latch arm (16) and knob (17), side plates (18) and the container-lift assembly cover (19).

The hydraulic power unit (2), shown on FIG. 1, is installed inside the cabinet on the frame (9) together with the directional control valve (20) and two solenoid operated on-off valves (21). The table (22) is removably installed in the cabinet, covering the power unit and the valves. The frame (9) has four caster wheels (23).

The slots (24) on the cabinet side walls for the vertical movement of the platen bar (3) are covered by sliding bars (25) made of plastic flat bar, and are attached to the platen bar (3) to move with it. The upper portion of the cabinet and the doors (14) and (15) are lined on the inside walls with plastic sheets (26).

Figure 4:
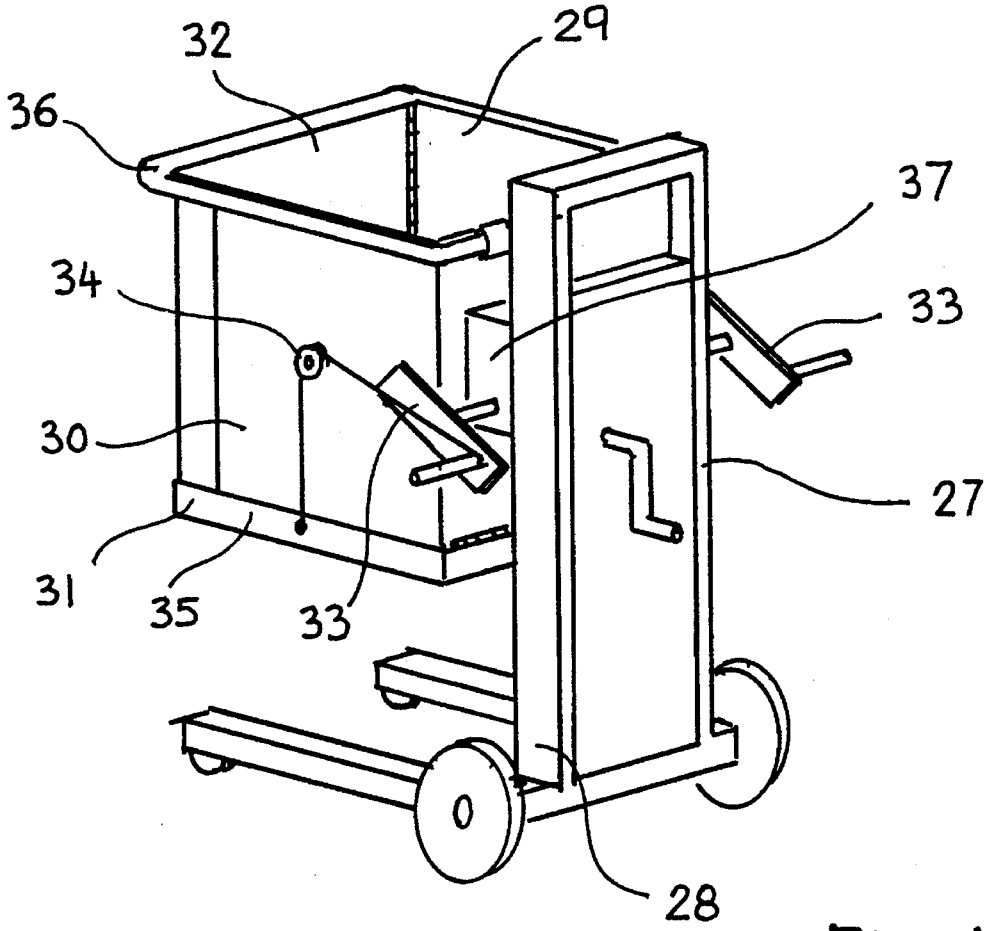
FIG. 4, is an isometric diagram of the container-lift assembly.

The container-lift assembly (27), shown on FIG. 4, comprises; the lift (28) and the container (29). It is removably inserted into the lower section of the cabinet placing the container on top of the table (22), and is held in place by the lift cover assembly (19), shown on FIG. 2. The container is removably attached to the lift. The container, shown on FIG. 4, comprises; three side walls (30), the hinged bottom plate (31) and the hinged door (32). The bottom plate is held in position by the pivoted rod and cable assembly (33) and the pulley (34). The pivot point of the rods (33) is placed on the container to reach an over-the-center position, locking the door in its closed position. Releasing the rod (33) from the over-the-center position allows the dropping of the bottom plate. The hinged door (32) is held in its closed position by the upward rim (35) of the bottom plate (31), and the hinged tubular rim (36). The container assembly is removably attached to the lift by the bracket (37). The lift (28)has a winch operated cable mechanism to raise and lower the container.

The compactor is operated hydraulically and is controlled electrically. The switches (38) control the solenoid operated hydraulic directional control valve for the up and down movement of the cylinder rods. The limit switches (39) stop the motion of the platen bar in both up and downward directions.

To control the angularity of the platen bar (3) in its downward motion, two electric switches (40) are installed on the platen bar, shown on FIG. 1. The switches are activated by the pin (41) which is attached to the upper end of the cylinder rod, and protrudes through the slot (42) of the platen bar. With the angularity of the platen bar relative to the cylinder rod, one of the switches is activated. The activated switch energizes the on-off hydraulic valve in the hydraulic circuit cutting off the flow of the hydraulic fluid to the port of the cylinder which is leading the other cylinder in the downward motion. With the cutting-off the flow to the leading cylinder the hydraulic fluid to the lagging cylinder increases, resulting in rapid correction of the level of the platen bar. The maximum angularity of the platen bar is adjustable by adjusting the position of the electric switches. The controlled angularity of the platen bar is also applied to increase the magnitude of the compacting forces on the material when the distribution of the material in the container is uneven, by holding the rod of the leading cylinder in a locked position, while allowing the other cylinder rod to move downward. The pin (4) of the locked cylinder serves as pivot point for the platen bar, adding a lever advantage for the active cylinder relative to the platen. The controlled angularity of the platen bar (3) and of the platen (7) also serves as means to exert lateral forces on the compacted material for better distribution in the container.

The electric circuit of the compactor is controlled by an electric switch (43) which is activated by the doors, such that the solenoid operated hydraulic direction control valve (20) can not be energized when the doors are open.

While the invention has been described and illustrated, it should be understood that changes may be made without departing from the principles thereof, accordingly the invention is to be limited by the literal interpretation of the claims appended thereto.

We claim:

1. Method for compacting and baling waste or refuse material, including;

(a) storing the uncompacted waste or refuse material in the container of a container-lift assembly inserted into the cavity of the baler-compactor and inside the enclosed confinement of the baler-compactor, (b) periodic compacting of the stored refuse or waste material into the container of the container-lift assembly, (c) refilling the enclosed confinement of the baler-compactor with uncompacted refuse or waste material after each periodic compacting until the desired size and density of the bale of the compacted material is achieved, (d) tying the compacted waste or refuse material with suitable tying material into bales or bundles, (e) transporting the compacted and tied bales to a temporary storage site in the container of the container-lift assembly of the baler-compactor, (f) releasing the baled waste or refuse material from the container of the container-lift assembly into the temporary storage site, (g) applying adjustable and automatically controlled angularity for the platen of the compactor during its downward motion to exert lateral forces on the material under compaction for improved distribution of the waste or refuse material inside the container of the container-lift assembly, (h) applying adjustable and automatically controlled angularity for the platen of the compactor to exert increased forces on the portion of the waste or refuse material which require larger forces for substantially uniform compacting.

* * * * *